US005634762A

United States Patent [19]

Kim

[11] Patent Number: 5,634,762

[45] Date of Patent: Jun. 3, 1997

[54] BOOM LOCKING DEVICE FOR A SKID STEER LOADER

[75] Inventor: In K. Kim, Incheon, Rep. of Korea

[73] Assignee: Daewoo Heavy Industries Ltd., Incheon, Rep. of Korea

[21] Appl. No.: 578,128

[22] Filed: Dec. 26, 1995

[30] Foreign Application Priority Data

Dec. 23, 1994 [KR] Rep. of Korea ..... 94-35369

[51] Int. Cl.[6] ..... B66C 23/00

[52] U.S. Cl. ..... 414/685; 212/292

[58] Field of Search ..... 414/680, 685; 188/67; 298/17 B; 172/466, 481; 212/292

[56] References Cited

U.S. PATENT DOCUMENTS 4,039,093 8/1977 Schmitz, Jr. et al. ..... 212/292 X 4,811,983 3/1989 Watts et al. ..... 188/67 X

*Primary Examiner*—Donald W. Underwood

*Attorney, Agent, or Firm*—Lowe, Price, LeBlanc & Becker

[57] ABSTRACT

A boom locking device for a skid steer loader includes a prop arm hingedly attached to a boom for swinging movement between a rest position generally in parallel to the boom and a proping position in a bearing engagement with the distal end of a boom cylinder housing to maintain the boom in a raised position against retraction of a boom cylinder piston rod. A release lever is pivotally attached to the free end of the prop arm, the release lever adapted for pivotal movement between an idle position in which the release lever is folded back onto the prop arm, an unfolded position in which the tip end of the release lever rides on the cylinder housing and an arm lifting position in which the release lever bears against the piston rod at the tip end thereof to lift up the prop arm out of engagement with the distal end of the cylinder housing.

8 Claims, 7 Drawing Sheets

BOOM LOCKING DEVICE FOR A SKID STEER LOADER

FIELD OF THE INVENTION

The present invention pertains generally to a skid steer loader and, more particularly, to a boom locking device for a skid steer loader adapted to make sure that a boom stays in a raised position during inspection or maintenance.

DESCRIPTION OF THE PRIOR ART

As well-known to those of ordinary skill in the art, a typical skid steer loader includes two pairs of discretely driven wheels each mounted to the flank sides of a vehicle body so as to provide the skid steer loader with an enhanced turning ability. Pivotally secured to the rear part of the vehicle body is a boom which protrudes forward past a driver's seat and has at its distal end a bucket or other attachments for a variety of applications. The boom may be raised up or lowered down by means of a boom cylinder that remains hingedly secured at its opposite ends to the vehicle body and the boom at an acute angle with respect to the boom.

The driver's seat in the skid steer load is enclosed by a canopy with a front opening through which the driver may gain access to the seal In order to perform inspection or maintenance for the engine and driving parts located underneath the driver's seat, it would be necessary to have the driver's seat and the canopy lifted up and folded back into an out-of-use position. Although the maintenance should ideally be carried out with the boom fully lowered down, there may sometimes occur an event that the boom has to be kept raised up by a boom cylinder during the entire period of maintenance. Apparently, the boom raised up by the boom cylinder makes the maintenance environment fatally hazardous because it may be unexpectedly and suddenly lowered down onto the repairman in the event that the boom cylinder should fail or should be mistakenly operated.

For this reason, it is preferable or even necessary that the boom be locked in the raised position against any inadvertent "downswing" each time the maintenance is to be performed with the boom kept raised up. One conventional technique of locking the boom in the raised position is to take advantage of a steel bar or wood stick with a length suitable for insertion between the boom and the distal end of a cylinder housing of the boom cylinder. The steel bar sandwiched in this way can act as a rigid support member that inhibits any retraction of a piston rod of the boom cylinder, keeping the boom stably in the raised position even in the case of boom cylinder failure. This technique is however disadvantageous in that two person should work together to fit the steel bar in place, one bringing the steel bar on the distal end of the cylinder housing and the other operating the skid steer loader to get the piston rod progressively retracted to the same length as that of the steel bar. Alternatively, it may be possible for the driver to install the steel bar by himself just after the boom has been raised up. This will in turn endanger the driver since there would exist a chance of the boom being abruptly lowered down in the process of installing the steel bar.

Another prior art technique of locking the boom in the raised position is to have the boom supported on the canopy by use of an overhead locking device that the driver can operate without having to leave the seal This technique allows the driver to lock up the boom with no fear of abrupt downswing of the latter. But a drawback cannot be avoided with this locking device that it becomes unable to remove the canopy and the driver's seat into an out-of-use position due to the hindrance or interference of the locking device.

SUMMARY OF THE INVENTION

Accordingly, it is an object of the invention to provide a boom locking device for a skid steer loader that permits the driver to lock and unlock a boom in a raised position in an effortless and safe manner, while assuring an easy removal of a driver's seat along with a conopy for the sake of maintenance.

With this object in view, the present invention provides a boom locking device for a skid steer loader having a vehicle body, a boom pivotally mounted to the body and a boom cylinder for causing the boom to swing up and down, the boom cylinder provided with a cylinder housing and a piston rod, the cylinder housing having a distal end and a proximal end pivotal to the body, the piston rod having a distal end extendibly fitted to the cylinder housing and a proximal end pivotal to the boom, comprising: a prop arm hingedly attached to the boom for swinging movement between a rest position generally in parallel to the boom and a proping position in a bearing engagement with the distal end of the cylinder housing to maintain the boom in a raised position against retraction of the piston rod; and a release lever having a tip end and pivotally attached to the free end of the prop arm, the release lever adapted for pivotal movement between an idle position in which the release lever is folded back onto the prop arm, an unfolded position in which the tip end of the release lever rides on the cylinder housing and an arm lifting position in which the release lever bears against the piston rod at the tip end thereof to lift up the prop arm out of engagement with the distal end of the cylinder housing.

BRIEF DESCRIPTION OF THE DRAWINGS

The above and other objects, features, advantages of the invention will become apparent from a review of the following detailed description of the preferred embodiment taken in conjunction with the accompanying drawings, in which.

DETAILED DESCRIPTION OF THE PREFERRED EMBODIMENT

Figure 1:
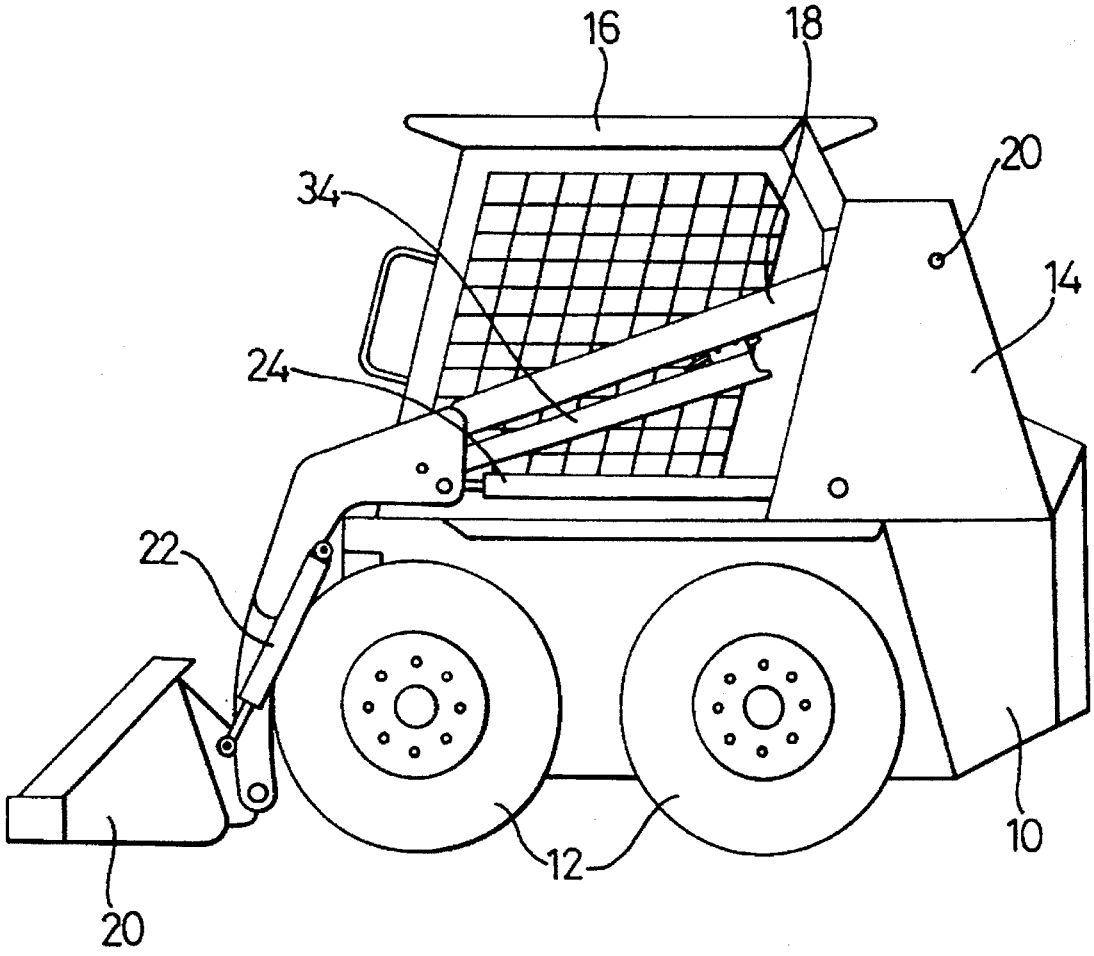
FIG. 1 is a side elevational view showing a skid steer loader that employs the boom locking device in accordance with the invention, with the boom in a lowered position.
Figure 4:
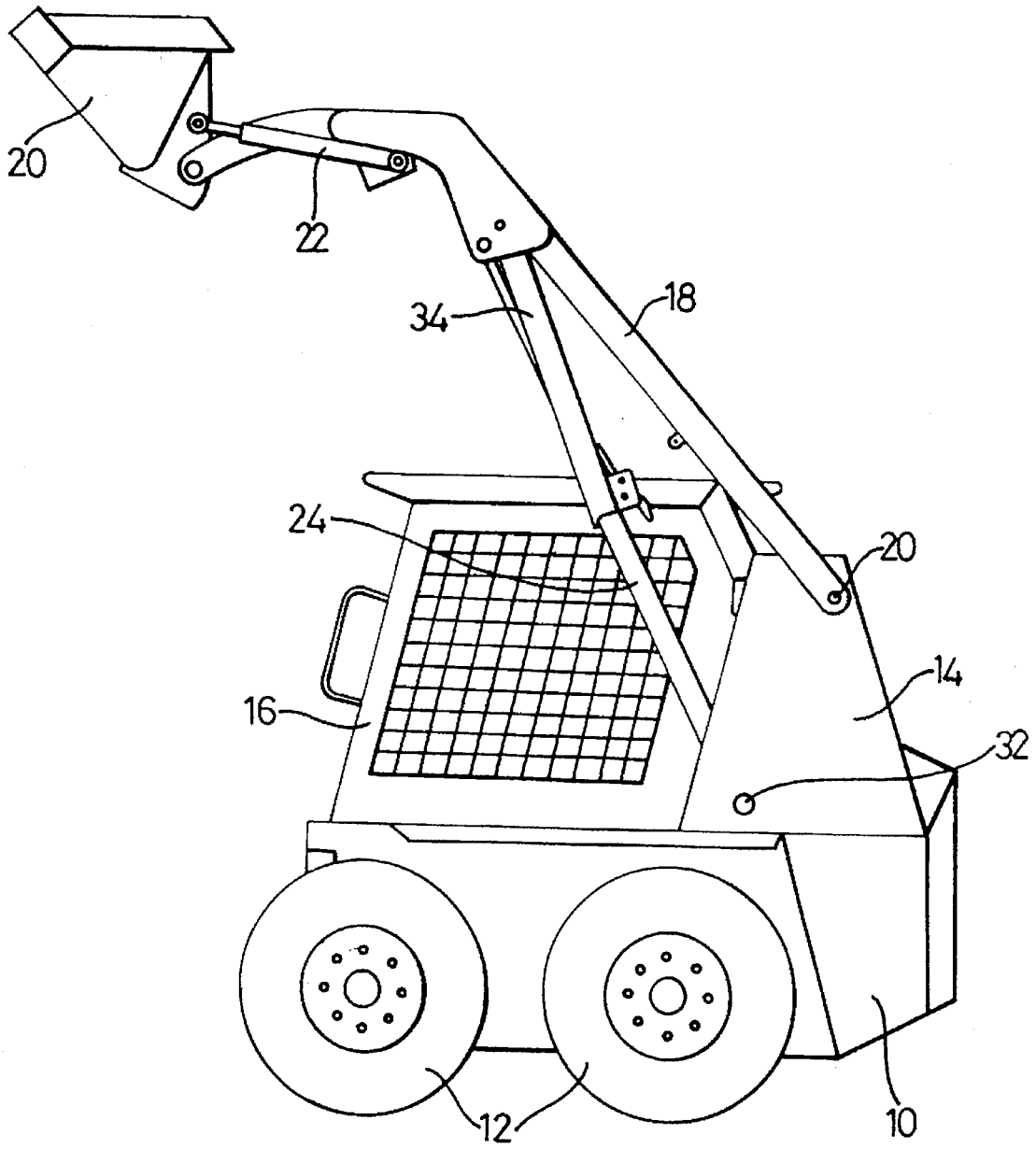
FIG. 4 shows a skid steer loader whose boom is locked in a raised position by the boom locking device.

Referring now to FIG. 1, there is illustrated by way of example a skid steer loader incorporating the boom locking device in accordance with the invention. The skid steer loader includes a vehicle body 10 movably supported by wheels 12 and provided at its rear side with an upright post 14. Mounted on the vehicle body 10 is a canopy 16 which encloses a driver's seat on three sides save for the front side, allowing the driver to gain access to the driver's seat through the front side. A boom 18 is pivotally secured to the upright post 14 of the vehicle body 10 for swinging movement about a pivot axis 20 between a lowered position as illustrated in FIG. 1 and a raised position as shown in FIG. 4. The boom 18 carries at its front end a bucket 20 which can be subjected to a pivotal movement by means of a bucket cylinder 22. The swinging movement of the boom is caused by a boom cylinder 24 pivoted at one end to the upright post 14 of the vehicle body 10 and at the other end to the middle extension of the boom 18.

Figure 2:
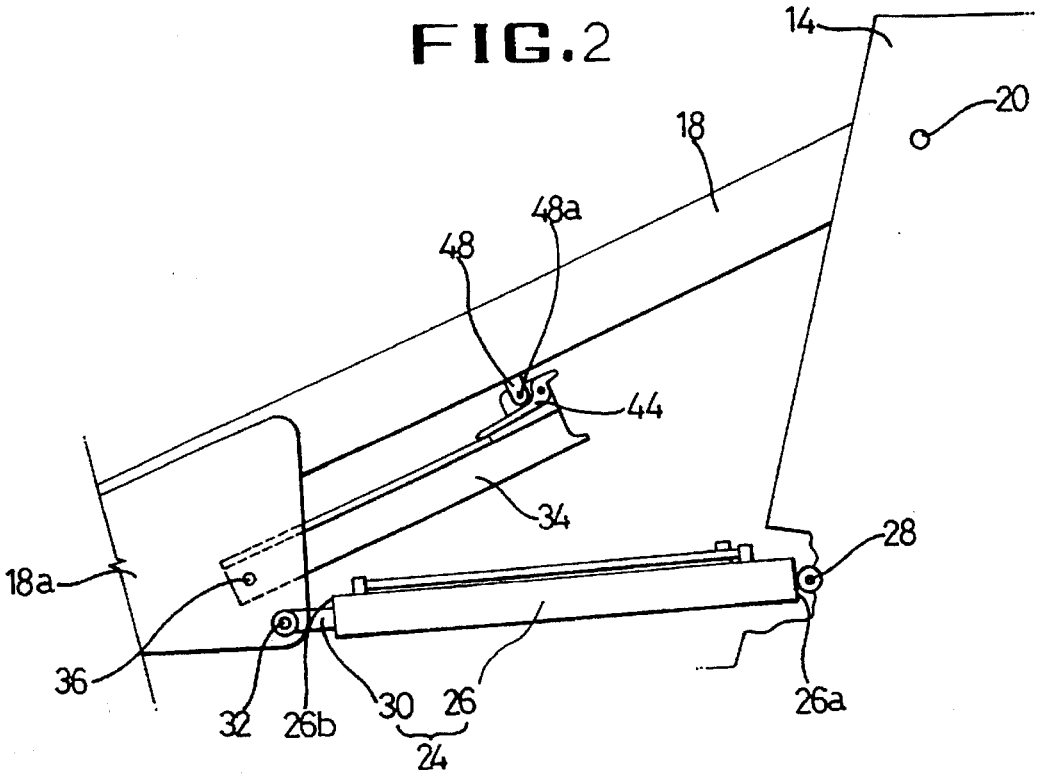
FIG. 2 is a partially cut away, enlarged view illustrating the structural relationship of the boom, the boom cylinder and the boom locking device.

As best shown in FIG. 2, the boom cylinder 24 is provided with a cylinder housing 26 of tubular configuration having a proximal end 26*a* pivoted to the upright post 14 by a pivot pin 28 and a distal end 26*b* kept free. The boom cylinder 24 further includes a piston rod 30 which has a proximal end pivoted to a support plate 18*a* of the boom 18 by a pivot pin 32 and a distal end extendibly fitted to the cylinder housing 26. By the action of a fluid under pressure, the piston rod 30 may be either extended to raise up the boom 18 into the raised position as shown in FIG. 4 or retracted to allow the boom 18 to swing down into the lowered position as depicted in FIG. 1. It should be a matter of course that the cylinder housing 26 has a greater diameter than the piston rod 30 so as to leave a shoulder or step at the distal end 26*b* thereof.

Figure 3:
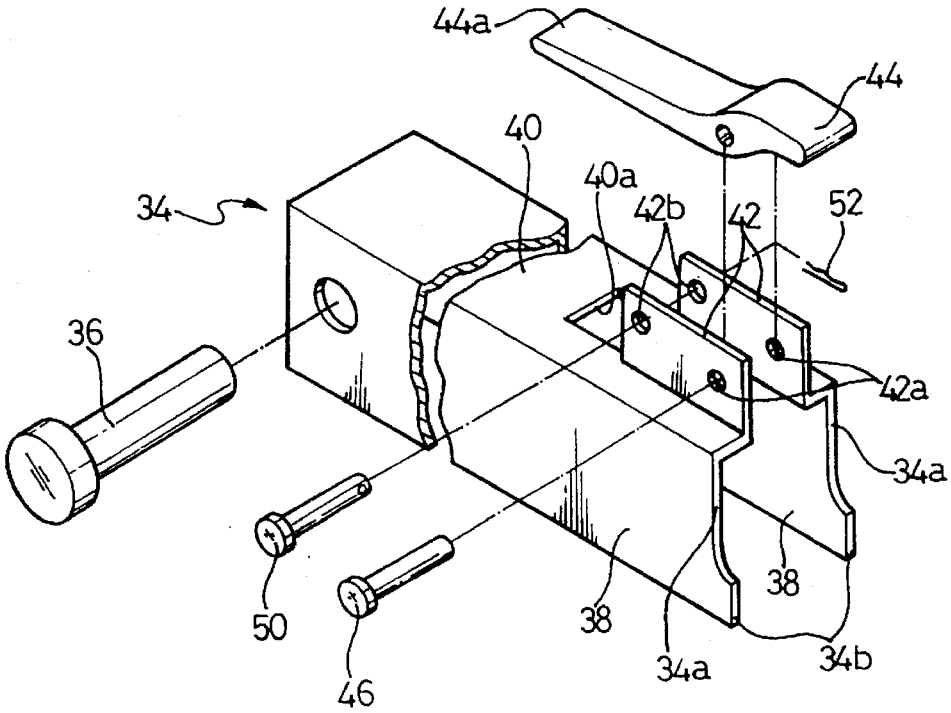
FIG. 3 is an exploded perspective view of the boom locking device in accordance with the invention.

One of the essential features of the invention is that an elongate prop arm 34 is hingedly attached to the support plate 18*a* of the boom 18 by a hinge pin 36 for swinging movement between a rest post position generally in parallel to the boom 18 as shown in FIG. 2 and a proping position in a bearing engagement with the distal end 26*b* of the cylinder housing 26 to maintain the boom 18 in the raised position against retraction of the piston rod 30. As is apparent in FIG. 3, the prop arm 34 includes a pair of spaced-apart, parallel side walls 38 that are interconnected at their top edges by a top wall 40 to form a trough of generally inverted "U"-shape cross-section. The side walls 38 are spaced apart by a distance somewhat smaller than the diameter of the cylinder housing 26 but greater than the diameter of the piston rod 30. This makes sure that the side walls can accommodate the piston rod 30 therebetween and can make a bearing contact with the distal end 26*b* of the cylinder housing 26 when the prop arm 34 is in the proping position.

The top wall 40 of the prop arm 34 has a longitudinal slot 40*a* open at the free end of the prop arm 34. Extending along the lateral edges of the slot 40*a* a shorter distance than the latter are a pair of arm brackets 42 spaced apart from each other with a spacing substantially equal to the width of the longitudinal slot 40*a*. Each of the arm brackets 42 has a pivot hole 42*a* and an anchor hole 42*b*, both of which are formed in a transverse direction of the prop arm 34. Meanwhile, the prop arm 34 has a terminal abutment surface 34*a* provided at the free ends of the side walls 38 and the top wall 40 in order to rest against the distal end 26*b* of the cylinder housing 26 as the prop arm 34 is brought into the proping position. Additionally and preferably, a detent nose 34*b* is projecting forwardly from the lower edge of the free end of the respective side wall 38 such that, when the prop arm is in the proping position, it can lie just below the cylinder housing 26 to prohibit the prop arm 34 from any inadvertent removal out of the proping position.

A release lever 44 with a tip end 44*a* is pivotally held between the arm brackets 42 by virture of a lever pin 46 fitted through the pivot hole 42*a* of the arm brackets 42. The release lever 44 is adapted for pivotal movement between three major positions, namely, an idle position in which the release lever 44 is folded back onto the prop arm 34 as indicated in FIG. 2, an unfolded position in which the tip end 44*a* of the release lever 44 is turned clockwise about the lever pin 46 to ride on the cylinder housing 26 of the boom cylinder 24 and an arm lifting position in which the release lever 44 is further turned clockwise from the unfolded position to bear against the piston rod 30 of the boom cylinder 24 to thereby lift up the prop arm 34 out of engagement with the distal end 26*a* of the cylinder housing 26 as well as with piston rod 30.

The prop arm 34 is normally retained in the rest position as illustrated in FIG. 2, by an anchor device which includes an anchor bracket 48 having a through-hole 48*a* and fixedly secured to the boom 18 in the swing trajectory of the arm brackets 42 of the prop arm 34 and an anchor pin 50 inserted through the anchor hole 42*b* of the respective arm bracket 42 and then the through-hole 48*a* of the anchor bracket 48. A split pin 52 is removably secured to the protruding end of the anchor pin 50 to hold the latter in place.

Figure 5:
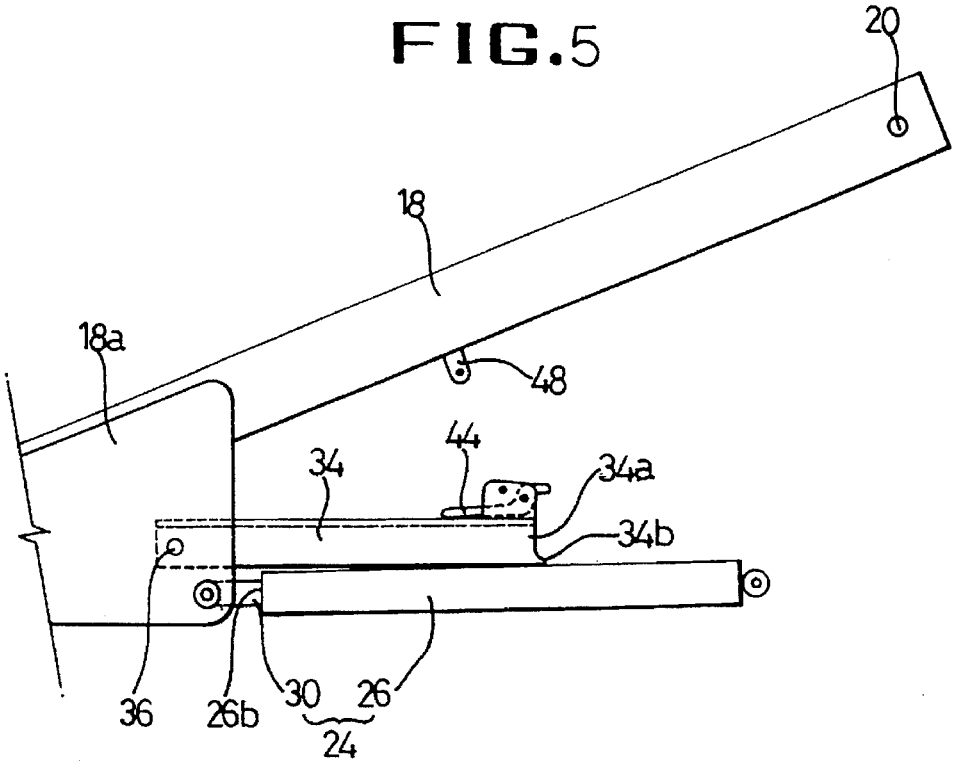
FIGS. 5 through 7 represents the steps of locking the boom in the raised position by use of the boom locking device.
Figure 6:
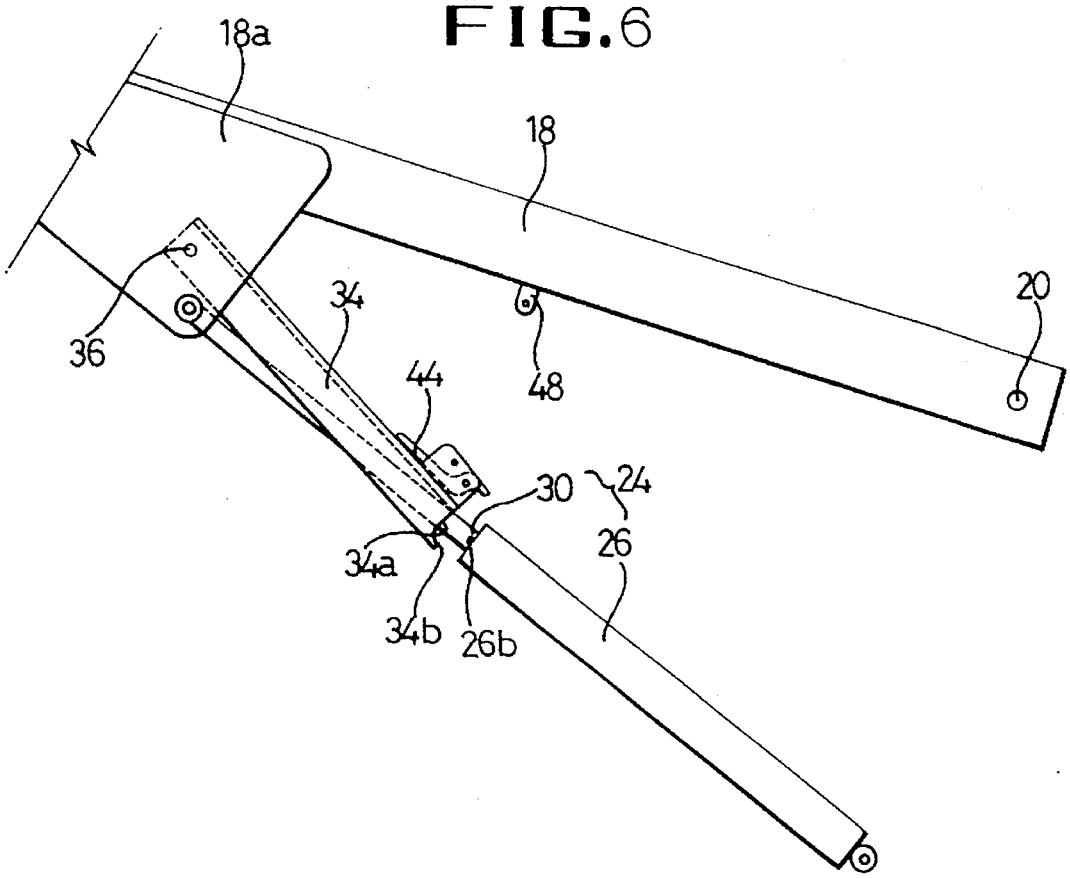
Figure 7:
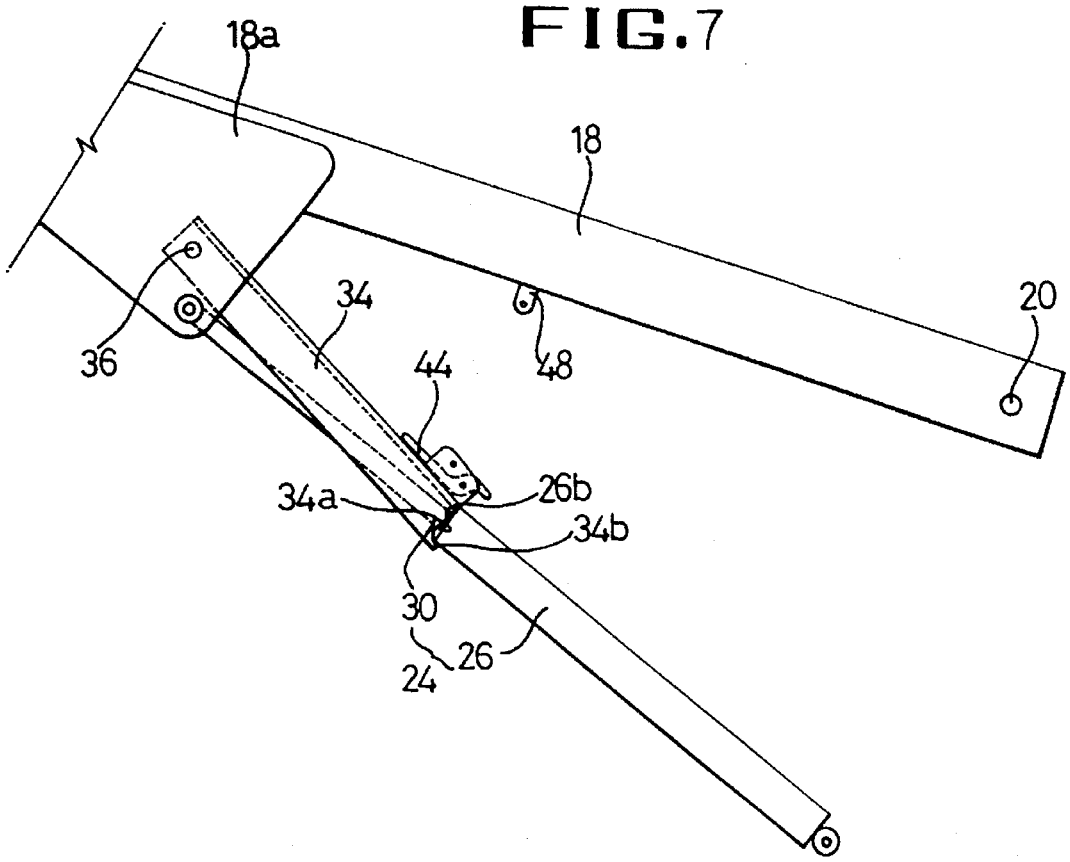

With particular reference to FIGS. 5 through 7, the boom locking process will be described in detail in the following. With the piston rod 30 of the boom cylinder 24 fully retracted and hence the boom 18 kept in the lowered position, the prop arm 34 is separated from the anchor bracket 48 of the boom 18 and is allowed to swing down out of the rest position to ride on the cylinder housing 26 of the boom cylinder 24 as illustrated in FIG. 5. Subsequently, by way of properly operating the hydraulic control system in the skid steer loader, the piston rod 30 is caused to fully extend so that a gap may be created between the distal end 26*b* of the cylinder housing 26 and the terminal abutment surface 34*a* of the prop arm 34 as clearly shown in FIG. 6. At this time, the prop arm 34 will come into contact with the piston rod 30 at its free end, rather than ride. on the cylinder housing 26. Slight retraction of the piston rod 30 in this state will bring the prop arm 34 into the proping position, as shown in FIG. 7, wherein the terminal abutment surface 34*a* of the prop arm 34 remains in a bearing engagement with the distal end 26*b* of the cylinder housing 26 to lock the boom 18 in the raised position against any retraction of the piston rod 30(see FIG. 4). In the way stated above, the driver is able to lock the boom 18 in the raised position without having to expose himself to a hazard of the boom being suddenly lowered down on his body in the locking process.

Figure 8:
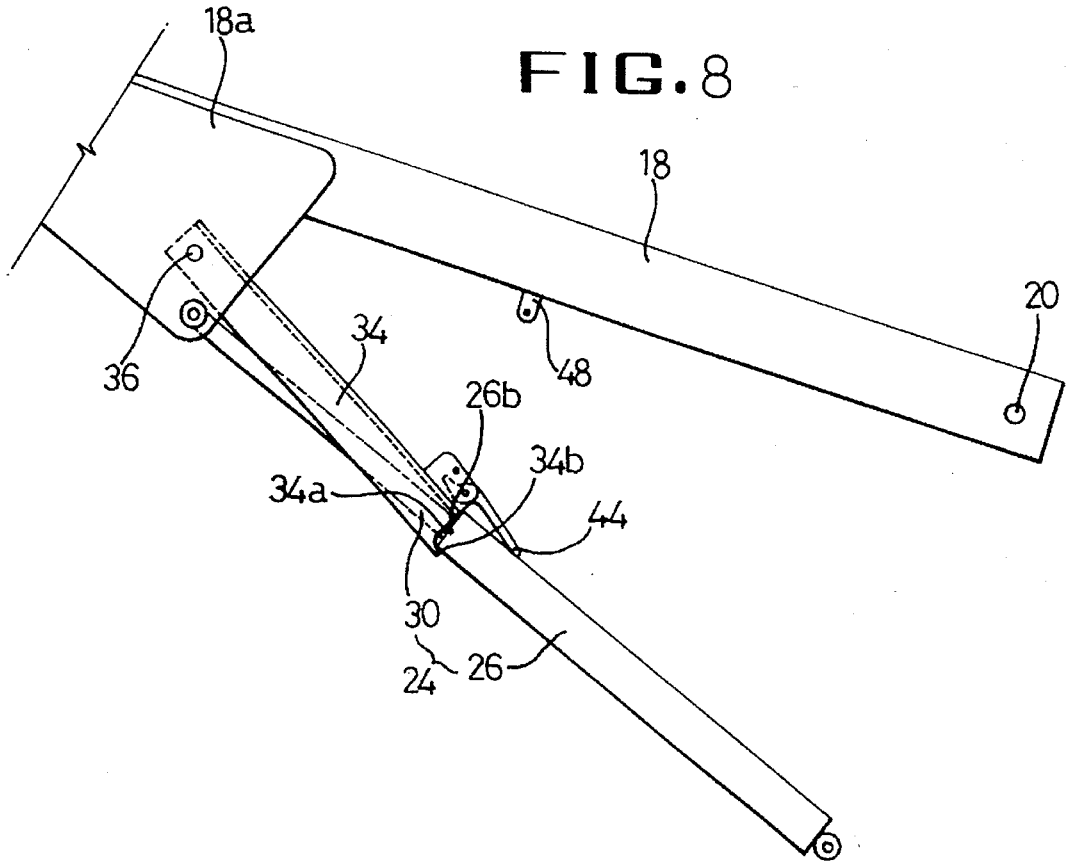
FIGS. 8 through 12 represents the steps of unlocking and lowering down the boom into a lowered position.
Figure 9:
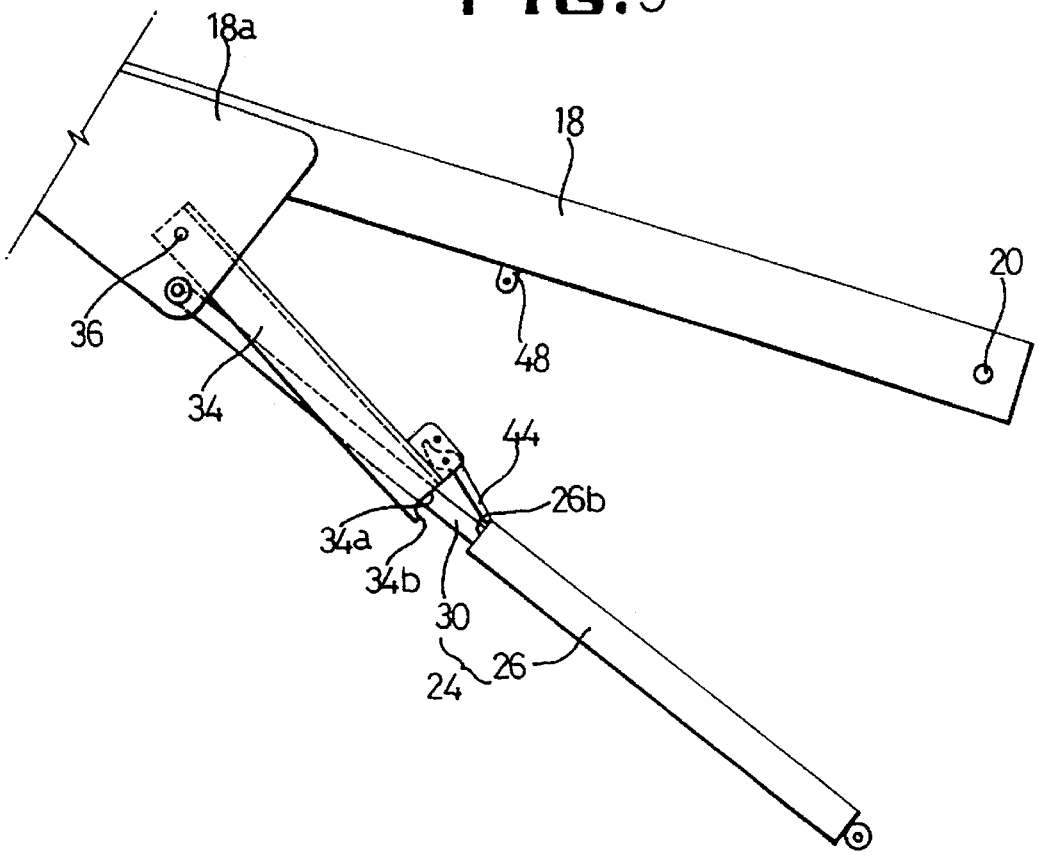
Figure 10:
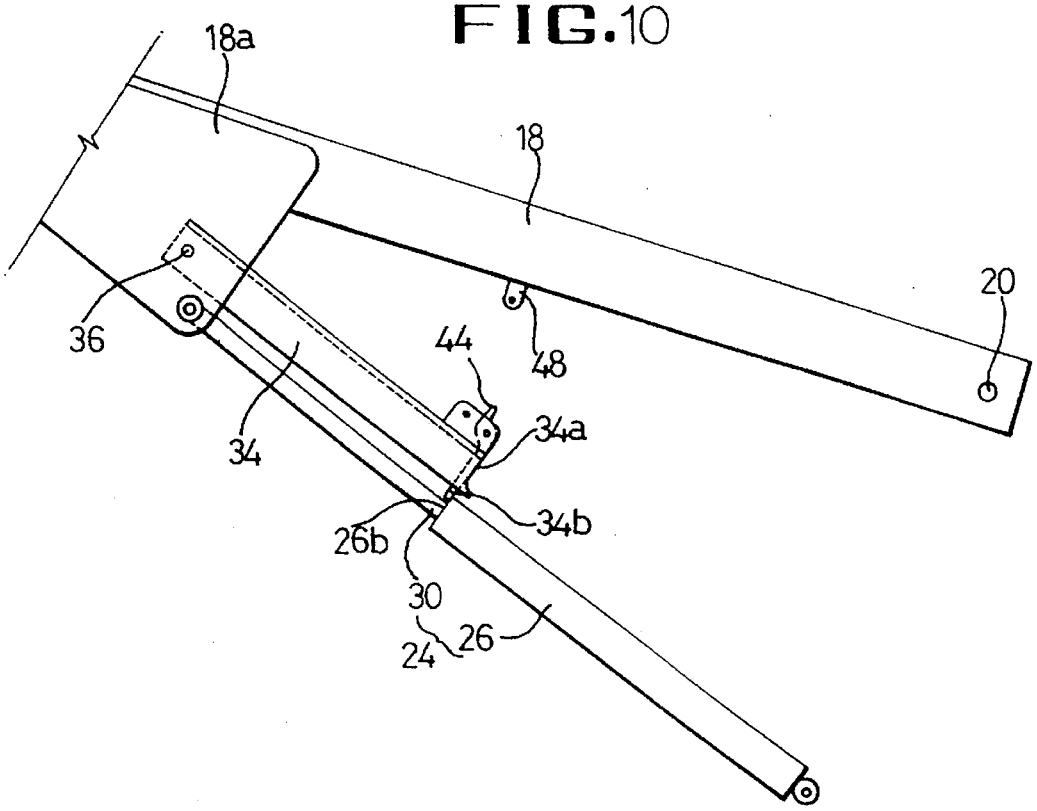
Figure 11:
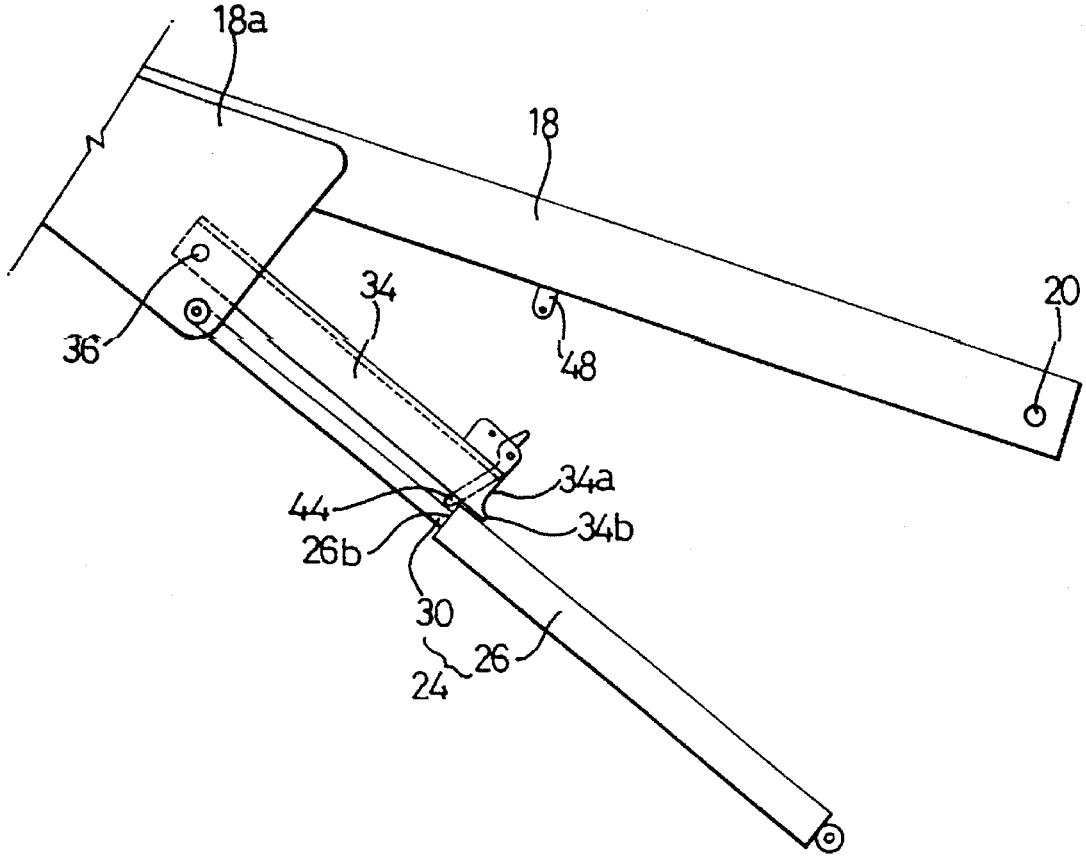
Figure 12:
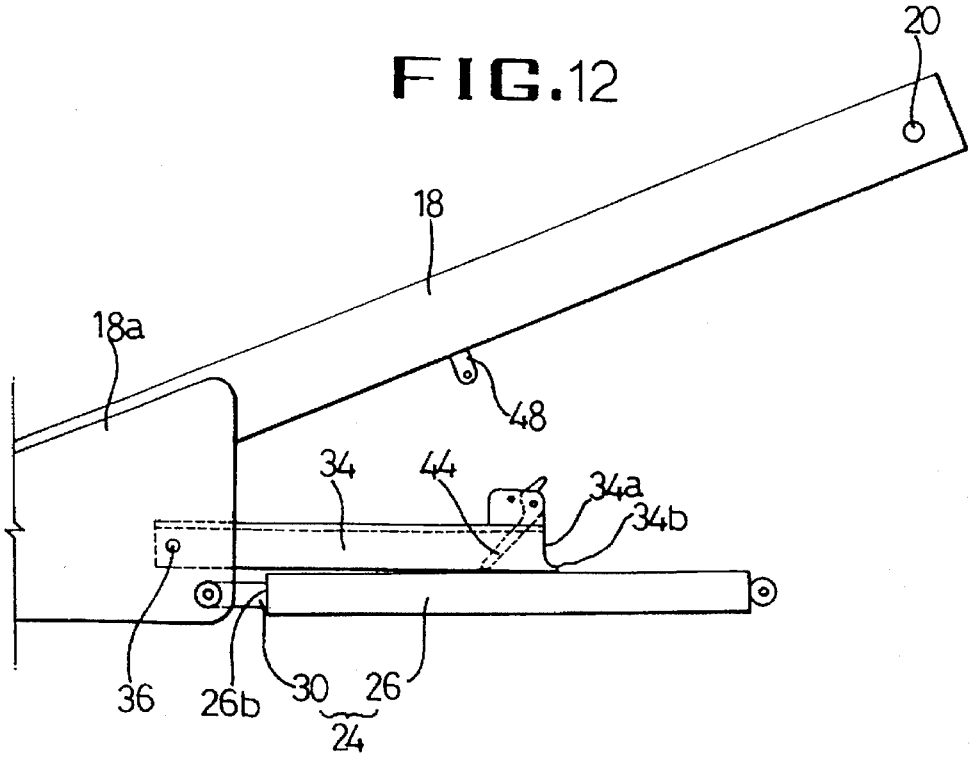

Unlocking the boom in the raised position is also easy to carry out as set forth hereinbelow with reference to FIGS. 8 through 12. The first step to be done in the unlocking process is to have the release lever 44 rotated clockwise such that the tip end of the release lever 44 can ride on the cylinder housing 26 as illustrated in FIG. 8. Slight extension of the piston rod 30 under that state will bring the the tip end of the release lever 44 into contact with the piston rod 30 as well as the distal end 26*b* of the cylinder housing 26 as represented in FIG. 9. The piston rod 30 is then caused to retract, in response to which the release lever 44 will be subjected to a further clockwise rotation as shown in FIG. 10, whereby the prop arm 34 is lifted up out of engagement with the piston rod 30 and the cylinder housing 26. Further retraction of the piston rod 30 will allow the prop arm 34 to ride on the cylinder housing 26 as shown in FIG. 11 so that the prop arm 34 may slide over and along the cylinder housing 26 as the piston rod 30 comes into a fully retracted position as illustrated in FIG. 12. Upon termination of the boom unlocking procedure in this way, the prop arm 34 should be anchored to the boom 18 to assure free extension and retraction of the piston rod 30.

While the invention has been shown and described with reference to a preferred embodiment, it should be apparent to one of ordinary skill that many changes and modifications may be made without departing from the spirit and scope of the invention as defined in the claims.

What is claimed is:

1. A boom locking device for a skid steer loader having a vehicle body, a boom pivotally mounted to the body and a boom cylinder connected to swing the boom up and down, said boom cylinder including a cylinder housing and a piston rod, the cylinder housing having a distal end and a proximal end pivoted to the body, the piston rod having a distal end extendibly fitted to the cylinder housing and a proximal end pivoted to the boom, said boom locking device comprising:

a prop arm hingeable to the boom for swinging movement between a rest position out of engagement with the piston rod and a propping position wherein the prop arm is in a bearing engagement with the distal end of the cylinder housing to prevent retraction of the piston rod; and a release lever having a tip end and pivotally attached to a free end of the prop arm, the release level adapted for pivotal movement between an idle position in which the release lever is folded back onto the prop arm, an unfolded position in which the tip end of the release lever is rideable on the cylinder housing and an arm lifting position in which the release lever can bear against the piston rod at the tip end thereof to lift up the prop arm out of engagement with the distal end of the cylinder housing.

2. The boom locking device for a skid steer loader as recited in claim 1, further comprising means for maintaining the prop arm in the rest position.

3. The boom locking device for a skid steer loader as recited in claim 1, wherein the prop arm is provided with a pair of spaced-apart parallel side walls interconnected at their upper edges by a top wall, the top wall having a longitudinal slot open at the free end of the prop arm and a pair of arm brackets each extending a shorter length than the slot along lateral edges of the longitudinal slot.

4. The boom locking device for a skid steer loader as recited in claim 3, wherein the side walls are spaced apart by a distance smaller than the diameter of the cylinder housing but greater than the diameter of the piston rod.

5. The boom locking device for a skid steer loader as recited in claim 3, wherein the prop arm has a terminal abutment surface provided at free ends of the side walls to bear against the distal end of the cylinder housing when the prop arm is in the proping position and a detent nose projecting from a lower edge of the free end of the respective side wall to lie below the cylinder housing when the prop arm is in the proping position.

6. The boom locking device for a skid steer loader as recited in claim 3, wherein each of the arm brackets has a pivot hole and an anchor hole formed in a transverse direction of the prop arm and wherein the release lever is pivotally attached to the arm brackets by a lever pin fitted through the pivot hole.

7. The boom locking device for a skid steer loader as recited in claim 6, further comprising means for maintaining the prop arm in the rest position including an anchor pin removably fitted through the anchor hole of the respective arm bracket to keep the prop arm out of the propping position.

8. The boom locking device for a skid steer loader as recited in claim 3, wherein the prop arm has a cross-section of generally inverted U-shape.

* * * * *